US006410868B1

(12) United States Patent
Berlemont et al.

(10) Patent No.: US 6,410,868 B1
(45) Date of Patent: Jun. 25, 2002

(54) CONTROLLED CURRENT DISTRIBUTION DEVICE WITH MECHANICAL LOCKING OF A PLUG INTO A CORRESPONDING RECEPTACLE

(75) Inventors: Laurent Berlemont, Fontenay sous Bois; Bernard Le Metay, Paris, both of (FR)

(73) Assignees: Legrand; Legrand SNC, both of Limoges (FR)

( * ) Notice: Subject to any disclaimer, the term of this patent is extended or adjusted under 35 U.S.C. 154(b) by 0 days.

(21) Appl. No.: 09/629,701

(22) Filed: Jul. 31, 2000

(30) Foreign Application Priority Data

Jul. 30, 1999 (FR) ..... 99 09939

(51) Int. Cl.[7] ..... H01H 9/20
(52) U.S. Cl. ..... 200/50.28; 439/347; 439/911
(58) Field of Search ..... 200/50.3, 50.31, 200/50.28, 50.09; 439/347, 911, 188, 352, 488, 489

(56) References Cited

U.S. PATENT DOCUMENTS 2,241,828 A * 5/1941 Reynolds ..... 200/50

FOREIGN PATENT DOCUMENTS

| | | |
|---|---|---|
| DE | 1 037 549 | 8/1958 |
| DE | 44 47 493 A1 | 12/1995 |
| EP | 0 632 540 A2 | 1/1995 |
| GB | 2 292 644 A | 2/1996 |

* cited by examiner

*Primary Examiner*—P. Austin Bradley
*Assistant Examiner*—Lisa N. Klaus
(74) *Attorney, Agent, or Firm*—Young & Thompson

(57) ABSTRACT

A current distribution device includes a socket outlet receptacle that is switched on and off by a switch. The device includes a socket outlet receptacle and a switch that is operated by an operating knob. The plug is locked into the receptacle by a mechanism that includes a cable extending between the switch and the receptacle.

15 Claims, 3 Drawing Sheets

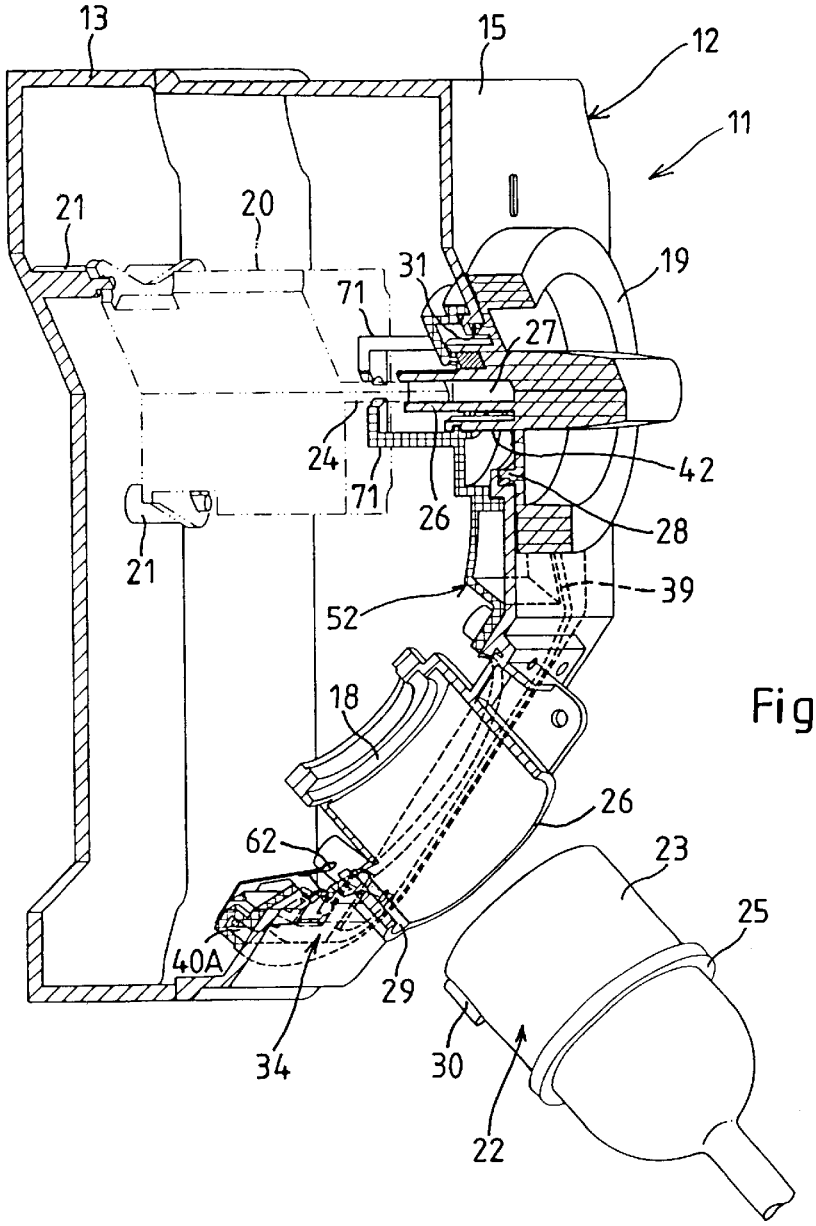
Fig.1
Fig.7
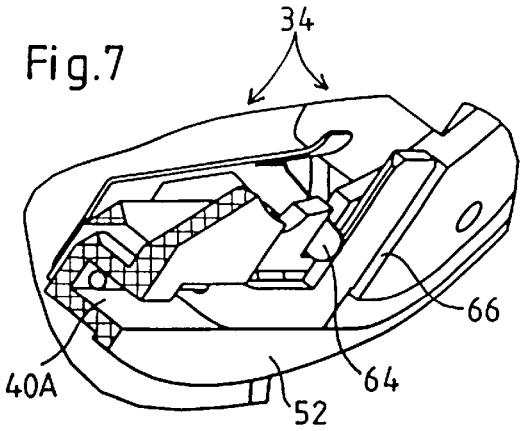
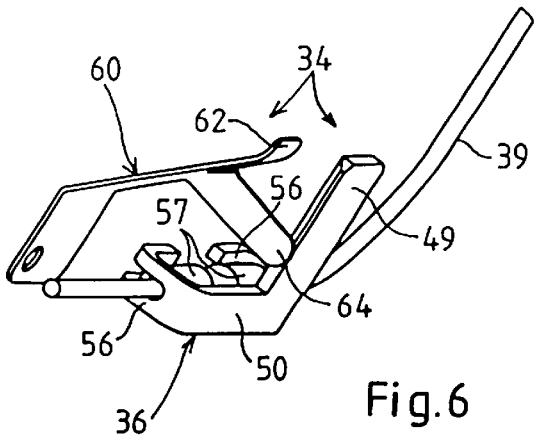
Fig.6

Fig.10
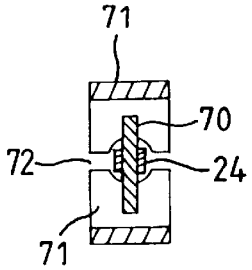
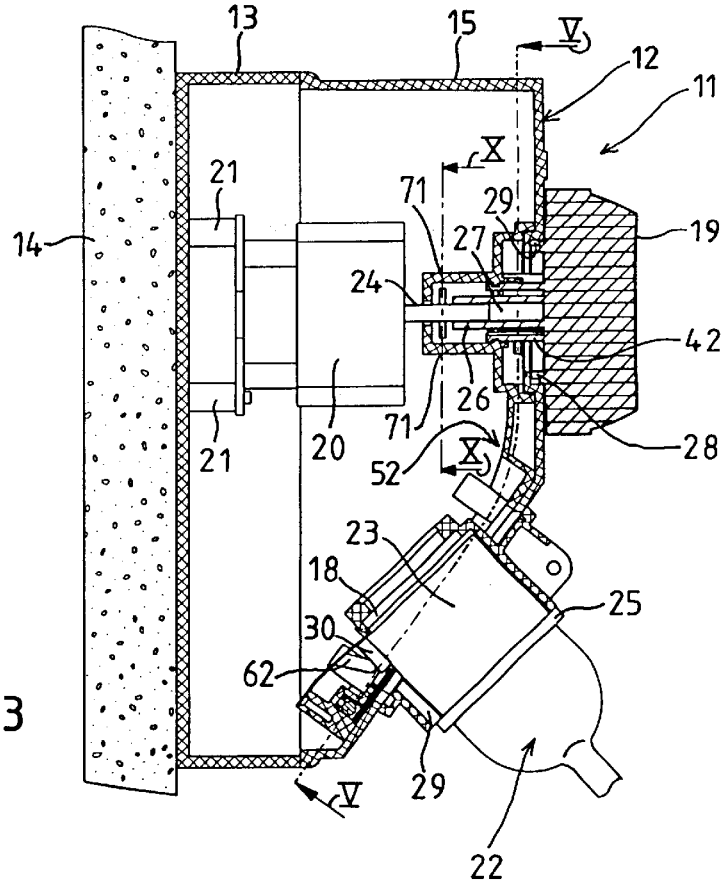
Fig.3
Fig.5
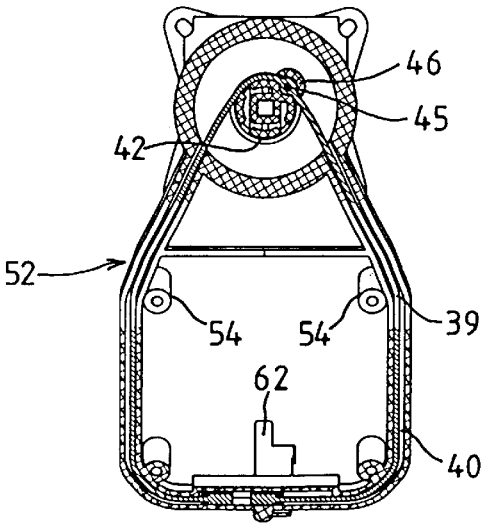
Fig.4
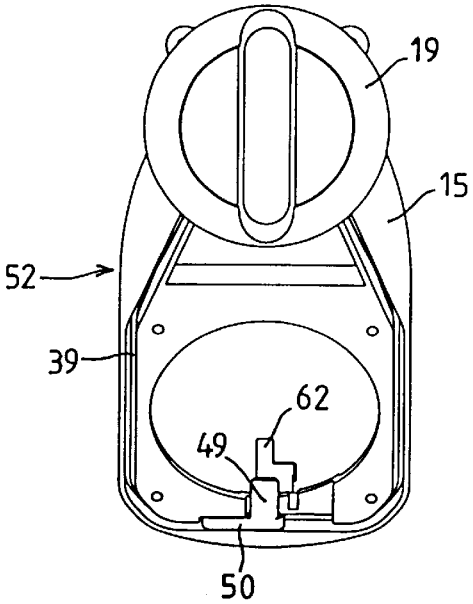

CONTROLLED CURRENT DISTRIBUTION DEVICE WITH MECHANICAL LOCKING OF A PLUG INTO A CORRESPONDING RECEPTACLE

BACKGROUND OF THE INVENTION

1. Field of the Invention

The invention relates to a controlled current distribution device, more particularly a device of the kind including in a common casing a socket outlet receptacle enclosing terminals of the socket (generally female terminals), a switch connected to switch the socket outlet receptacle on and off, and means for mechanically locking a plug into the socket outlet receptacle.

The invention relates more particularly to a new arrangement of the above three subassemblies, which are simpler and more reliable than those currently available.

2. Description of the Prior Art

The standards governing some socket outlets, in particular socket outlets for high currents, require the socket outlet receptacle to be switched off when no plug is actually inserted into the receptacle and operation of the switch to switch the socket outlet receptacle on to be prevented when no plug is actually inserted into the receptacle.

Various locking principles using diverse mechanisms between the switch and the receptacle have previously been proposed, such that operation of the switch is conditional on the presence of a plug in the receptacle and mechanical locking of the plug in the receptacle when the receptacle is switched on. The prior art mechanisms employ cams, sliders or gears.

The invention proposes a new device in which the coupling between the means for locking the plug and the switch is provided by a cable.

SUMMARY OF THE INVENTION

To be more precise, the invention therefore provides a controlled current distribution device of the type comprising, in a common casing, a socket outlet receptacle and a switch that are electrically interconnected so that switching on the socket outlet receptacle is conditional on the position of the switch, wherein the receptacle includes a lateral groove oriented in the direction of insertion of a corresponding plug incorporating a lug adapted to engage in and slide in the groove, a locking mechanism between the switch and the groove and adapted to cooperate with the lug to make connecting or disconnecting the plug conditional on a position of the switch in which the socket outlet receptacle is switched off, the locking mechanism includes a locking member mobile along a transverse path relative to the groove and enabling it to cooperate with the lug to lock the plug in position and the locking member is attached to a cable installed and guided in the casing and connected to a mobile member of the switch.

The cable is installed in the casing in a loop. An advantageous embodiment of the device includes an internal support extending between the switch and the receptacle and the guide is partly formed within an imprint in the support. The internal support is fixed against the inside face of a wall of the casing so that the cable is confined within a space defined by the imprint and the inside face.

The locking member includes a tongue adapted to cooperate with a lug and carried by a slider installed in a rectilinear groove forming part of the guide.

The tongue and the slider are rigidly connected and the slider is mounted in the rectilinear groove so that it cannot pivot on itself. Consequently, if the tongue is moved into contact with one end of a lug on the plug, the plug is mechanically locked into the receptacle.

Consequently, when the tongue is at a position far away from the path of the lug on the plug, which path is materialized by the groove that is defined on the side of the receptacle, the plug can be connected or disconnected without difficulty. This position of the tongue corresponds to a position of the switch in which its contacts are open and the socket outlet receptacle is consequently switched off.

On the other hand, when the tongue is engaged in the extension of the lateral groove the plug connected to the socket outlet receptacle is mechanically locked to it and the receptacle is switched on.

According to an other important feature of the invention, a locking leaf spring is mounted in the vicinity of the locking member and includes a claw in line with the groove so as to be moved by the lug on the plug and a mobile abutment is shaped and positioned to hold the locking member in a position away from the path of the lug on the plug defined by the lateral groove, in which position the switch is open, and is retracted when the claw is moved by the lug on the plug. In this position, the switch is open and cannot be closed unless a plug is inserted into the socket outlet receptacle.

Connecting the plug causes the mobile abutment to be retracted when the claw is moved by the lug on the plug. Thus the switch cannot be operated, i.e. closed, until the mobile abutment has been retracted and operation of the switch is accompanied by movement of the tongue, which locks the plug into the socket outlet receptacle.

The invention will be better understood and other advantages of the invention will become more apparent in the light of the following description of a current distribution device according to the invention, which description is given by way of example only and with reference to the accompanying drawings.

BRIEF DESCRIPTION OF THE DRAWINGS

FIG. 1 is a general perspective view in elevation and partly in section of a current distribution device according to the invention, showing the device switched off and not in service.

FIG. 2 is a view analogous to FIG. 1 showing a plug connected to and locked to the socket outlet receptacle of the device, that is switched on.

FIG. 3 is a view in elevation and in section of the device in service and mounted on a wall.

FIG. 4 is a plan view of an internal support extending between the switch and the socket outlet receptacle and enclosing an operating cable and shows the operating knob in place.

FIG. 5 is a view similar to FIG. 4 in section taken along the line V—V in FIG. 3.

FIG. 6 shows a detail to a larger scale with the tongue and its locking leaf spring in a locked position.

FIG. 7 shows another detail with the components from FIG. 6 in place in the internal support and in the same locked configuration.

FIG. 10 is a view to a larger scale and in section taken along the line X—X in FIG. 3.

DETAILED DESCRIPTION OF THE PREFERRED EMBODIMENTS

Figure 2:
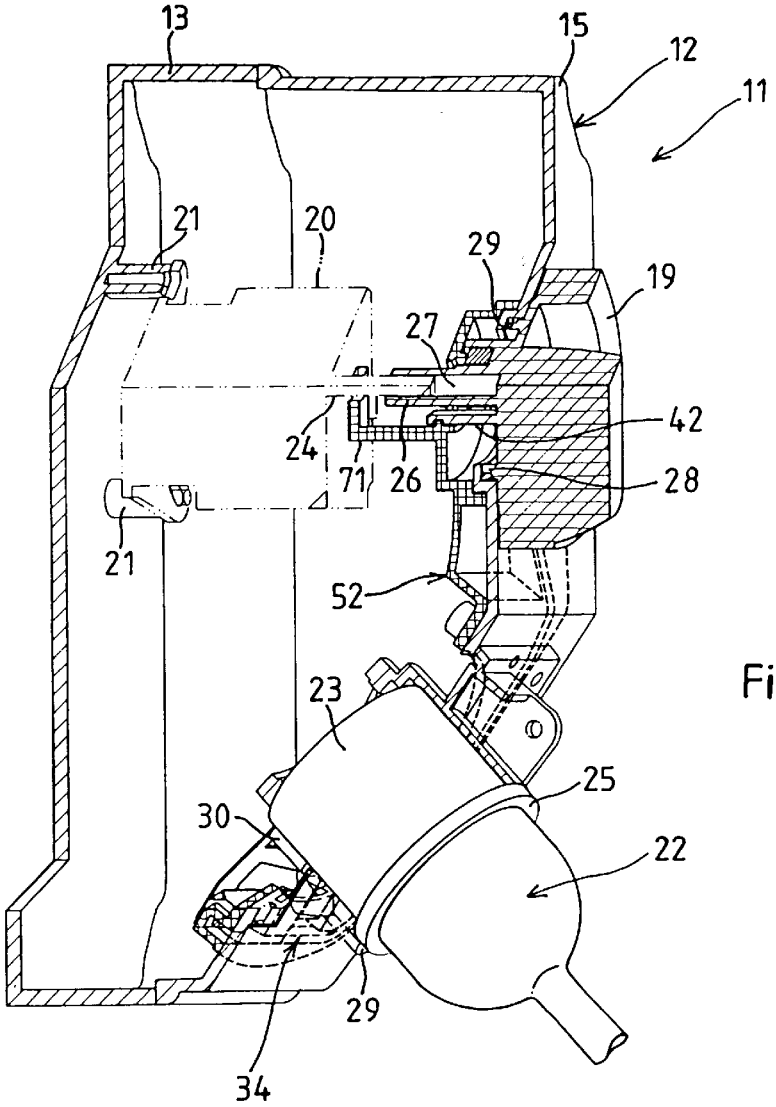

The controlled current distribution device 11 shown comprises a housing 12 having a back 13 adapted to be fixed to a wall 14 and a cover 15 that nests with and is fixed to an upstanding edge of said back. The cover carries a number of essential components of the device, in particular a socket outlet receptacle 18 and a rotary operating knob 19 of a switch 20. The switch is fastened to the back 13 and is mounted on upstands 21 that are preferably made of plastics material and molded in one piece with or attached to the wall of the back. The switch is therefore at a small distance from the mounting wall of the back. The switch is conventional and is shown only in dashed outline to avoid overcomplicating FIGS. 1 and 2. It includes an operating shaft 24, that has a square cross section in this example, and that is capped by the operating knob 19, that is made from an insulative plastics material and includes an axial tubular sleeve 26 incorporating a square section blind hole 27 in which the operating shaft of the switch is a tight sliding fit.

Consequently, the operating shaft and the operating knob are rotationally coupled by the sleeve but can be separated in the axial direction. The operating knob also has an annular rib 28 guided when the knob rotates against an annular shoulder 29 defined all around a circular opening in the top face of the cover 15, so constituting a sealing barrier.

The socket outlet receptacle 18 is attached to the cover and fixed to it by screws (not shown) or any other equivalent means.

The drawings do not show the socket inside the receptacle and including in particular the female terminals of the socket outlet. The electrical wires connecting the female terminals to the mains supply via the switch 20 are not shown either. The receptacle is shown only by a cylindrical insulative plastics material skirt that has on its outside (i.e. on the part of the skirt that projects beyond the cover of the device) a lateral polarizer groove 29 extending in the direction in which a corresponding plug is inserted. The tubular skirt guides the plug.

The plug 22 is conventional and is shown in FIG. 1. It also includes a cylindrical skirt 23 with the male terminals inside it. The length of the skirt corresponds to the distance by which the plug 22 can be inserted into the receptacle 18. The skirt 23 has a flange 25 or an attached seal that bears against the edge 26 of the skirt of the receptacle when the plug is fully inserted. Note that the plug 22 includes a polarizer lug 30 adapted to engage in and slide in the groove. The length of this lug is notably less than the length of the skirt of the plug on which it is provided and it should be noted that the groove 29 is not extended into the interior of the housing. As a result of this, when the plug is pushed fully home in the receptacle, the lug is completely freed from the groove through which it has been inserted.

As explained below, this feature enables mechanical locking of the plug 22 into the socket outlet 18. A locking mechanism 34 between the switch 20 and the groove 29 cooperates with the lug 30 to make connecting or disconnecting the plug conditional on the switch being in a position in which the socket outlet receptacle is switched off.

According to one important feature of the invention, the locking mechanism 34 includes a locking member 36 that can move along a path transverse to the groove 29 in the side of the receptacle and enabling it to cooperate with the lateral lug 30 on the plug 22 to lock the plug in the connected position. The locking member is attached to a cable 39 installed in a guide 40 inside the casing 12. The cable 39 is connected to a mobile member of the switch, that in this example is a portion of the operating knob 19. The knob has a hub 42 inside the casing and coaxial with the tubular sleeve 26, that is rotationally coupled to the operating shaft 24 of the switch.

The hub 42 is constrained to rotate with the shaft 24 and the cable 39 is wound onto the hub and attached to it at one point.

To be more precise, the cable carries a pin 45 or the like that is inserted into a housing 46 at the periphery of the hub. The cable 39 is installed in a loop in the guide 40. The locking member 34 includes a tongue 49 adapted to cooperate with the lug 30 on the plug and the tongue is carried by a slider 50 installed in a rectilinear groove 40A that is part of the guide 40.

According to another beneficial feature of the invention, the device includes an internal support 52 extending between the receptacle 18 and the switch 20 (to be more precise its operating shaft and the lower part of the operating knob). The guide 40 is partly formed by an imprint in the support. The support is fixed against the bottom face of the front wall of the cover 15 so that the cable 39 is confined within a space defined by the imprint and by the inside face of the front wall of the casing. The locking member 36 is slidably mounted in the internal support 52, which includes the aforementioned rectilinear groove 40A.

As shown in the drawings, the front wall of the cover has two parts defining an obtuse angle dihedron. The operating knob 19 is installed on one part parallel to the back of the housing and the receptacle 18 is installed on an adjacent part defining a dihedron with the first part. Thus when the housing is mounted on a vertical wall, as shown in FIG. 1, the receptacle 18 is oriented so that it projects downwards, which reduces the size when a plug is connected, improves the radius of curvature of the cable to which the plug is connected and prevents the accumulation of dust or dirt, that may be conductive, around the socket outlet receptacle.

Of course, the internal support 52, that is pressed against the inside face of the front wall of the housing, itself has two parts defining an obtuse angle dihedron between them. The internal support 52 is made by molding or otherwise. It includes upstands 54 around the opening in which the receptacle is mounted. The upstands receive self-tapping or other screws. The receptacle includes a flange that is pressed onto the outside face of the front wall and the screws attach the flange to the upstands.

The two ends of the cable 39 are attached to respective opposite ends of the slider 50, thus closing the loop. The slider 50 includes two facing hooks 56 to which the respective ends of the cable are attached. The cable ends are fitted with enlarged end-pieces 57 retained in the hooks.

A locking leaf spring 60, for example a metal leaf spring, is mounted on the internal support 52 in the vicinity of the path of movement of the locking member. The blade has a claw 62 in line with the lateral groove 29 in the receptacle; it can therefore be moved by the lug 30 on the plug when a plug is inserted into the receptacle. The leaf spring further includes a mobile lateral abutment 64 that is shaped and positioned to hold the locking member, to be more precise the tongue 49, in a position far away from the path of the lug on the plug, which path is defined by the lateral groove. This position is shown in FIG. 7. In this position, the switch is open. Also, a fixed abutment 66 is defined on the internal support 54 at a location such that the locking member is held between the fixed abutment 66 and the mobile abutment 64 of the leaf spring when no plug is connected to the socket outlet receptacle.

Consequently, until the receptacle 18 receives a plug 22, the switch is open and cannot be operated because the operating knob 19 is immobilized by the cable 39 and the locking member 36. On the other hand, as soon as a plug 22 is inserted into the socket outlet receptacle 18 the lug 30 moves the claw of the locking leaf spring, which lowers the mobile abutment 64 and releases the locking member 36. It is only from this time that the operating knob 19 can be actuated to close the switch, i.e. to switch on the socket outlet receptacle.

Note that the internal support 52 is shaped to define a cavity around the tubular sleeve that is rotationally coupled to the operating shaft of the switch. In particular, the hub 42 has a groove at its end that cooperates with a circular rib on the internal support 52, snap-fastener fashion.

Also, a pin 70 is fixed transversely to the operating shaft of the switch and is inserted between two extensions 71 of the internal support. The operating shaft 24 extends between these two extensions, that define a slot 72 enabling the pin to be released. The position of the slot is such that the cover 15 can be removed only with the switch 20 in a predetermined position in which its electrical circuit is open.

The operation of the device is extremely simple and is clear from the foregoing description. The socket outlet receptacle 18, to be more precise its electrical part, is connected to the mains supply via the switch 20. Consequently, when the switch is open, no voltage is available at the receptacle. Given the arrangement as described above, the switch can be closed or opened only if a plug 22 is fully inserted into the socket outlet receptacle 18. Also, the plug can be plugged in or unplugged only if the tongue 49 is not on the path of movement of the lug 30, i.e. if the locking member is immobilized between the fixed and mobile abutments, as shown in FIG. 7.

Figure 9:
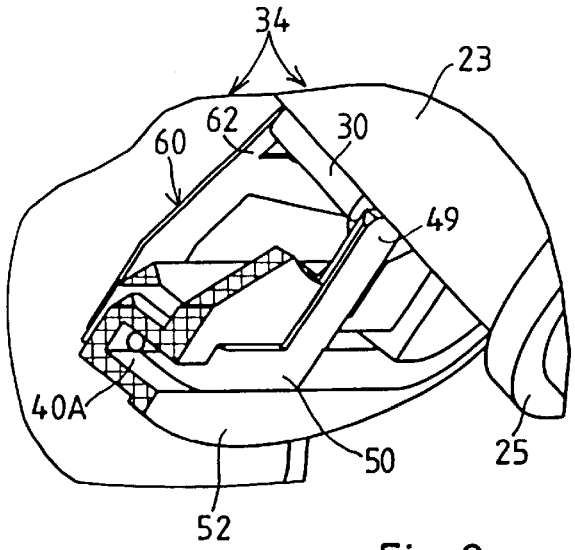
FIG. 9 is a view analogous to FIG. 7 showing the tongue and the leaf spring in the same positions as in FIG. 8.
Figure 8:
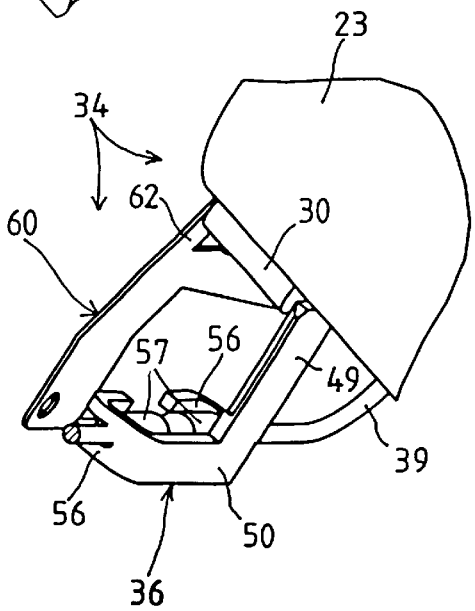
FIG. 8 is a view similar to FIG. 6 showing unlocking by movement of the leaf spring when a plug including a polarizer lug is inserted into the socket outlet receptacle.

When the plug is inserted, the locking leaf spring 60 is moved by the lug and the switch can be operated. The user must then turn the knob 19 to switch on the socket outlet receptacle by closing the switch. As soon as the switch 20 is closed, the locking member is moved into the position shown in FIG. 9 and opposes withdrawal of the plug 22.

What is claimed is:

1. A controlled current distribution device comprising, in a common casing, a socket outlet receptacle and a switch that are electrically interconnected so that switching on said socket outlet receptacle is conditional on the position of said switch, wherein said receptacle includes a lateral groove oriented in the direction of insertion of a corresponding plug incorporating a lug shaped to allow the lug to engage in and slide in said groove, a locking mechanism between said switch and said groove, the locking member cooperating with said lug to make connecting or disconnecting said plug conditional on a position of said switch in which said socket outlet receptacle is switched off, said locking mechanism includes a locking member mobile along a transverse path relative to said groove and enabling it to cooperate with said lug to lock said plug in position and said locking member is attached to a driving cable installed and guided in said casing and connected to a mobile member of said switch.

2. The device claimed in claim 1 wherein said cable is installed in said casing in a loop.

3. The device claimed in claim 1 wherein said cable is installed in a guide in said casing.

4. The device claimed in claim 3 wherein said locking member includes a tongue shaped to allow the tongue to cooperate with a lug and carried by a slider installed in a rectilinear groove forming part of said guide.

5. The device claimed in claim 4 wherein both ends of said cable are connected to said slider, on respective opposite sides thereof, so closing said loop.

6. The device claimed in claim 5 wherein said slider includes two facing hooks to which respective ends of said cable are attached and said ends of said cable are provided with respective enlarged end-pieces retained in said hooks.

7. The device claimed in claim 1 wherein said switch has an operating shaft capped by an operating knob that includes a hub constrained to rotate with said operating shaft and said cable is wound around said hub and attached thereto at one point.

8. The device claimed in claim 7 wherein said cable carries a pin engaged in a housing at the periphery of said hub.

9. The device claimed in claim 3 including an internal support extending between said switch and said receptacle and wherein said guide is partly formed within an imprint in said support.

10. The device claimed in claim 9 wherein said internal support is fixed against the inside face of a wall of said casing so that said cable is confined within a space defined by said imprint and said inside face.

11. The device claimed in claim 9 wherein said locking member is slidably mounted in said internal support.

12. The device claimed in claim 1 including a locking leaf spring mounted proximate said locking member and including a claw inline with said groove so as to be moved by said lug on said plug and a mobile abutment that is shaped and positioned to hold said locking member in a position away from the path of said lug on said plug defined by said lateral groove, in which position said switch is open, and is retracted when said claw is moved by said lug on said plug.

13. The device claimed in claim 2 including a fixed abutment on said internal support at a location such that said locking member is immobilized between said fixed and mobile abutments when no plug is connected to said socket outlet receptacle.

14. The device claimed in claim 9 wherein said switch has an operating shaft capped by an operating knob that includes a hub constrained to rotate with said operating shaft and said cable is wound around said hub and attached thereto at one point, said casing has a back carrying said switch and a cover carrying said socket outlet receptacle, said internal support and said operating knob, and said operating knob is rotatably mounted in a cavity defined between said cover and said internal support.

15. The device claimed in claim 14 including a pin fixed transversely to said operating shaft and inserted between two extensions of said internal support and wherein said two extensions define a slot whose position is such that said cover is removable only if said switch is in a predetermined position in which its electrical circuit is open.

* * * * *